United States Patent [19]

Versaw

[11] Patent Number: 4,626,821

[45] Date of Patent: Dec. 2, 1986

[54] SEALED THERMOSTAT FOR USE IN DEFROST CONTROL SYSTEMS

[75] Inventor: Douglas P. Versaw, Mansfield, Ohio

[73] Assignee: Thermo-O-Disc, Incorporated, Mansfield, Ohio

[21] Appl. No.: 794,440

[22] Filed: Nov. 4, 1985

[51] Int. Cl.[4] ..... H01H 37/04

[52] U.S. Cl. ..... 337/380; 337/112

[58] Field of Search ..... 337/380, 112, 354, 372

[56] References Cited

U.S. PATENT DOCUMENTS

| | | | |
|---|---|---|---|
| 4,282,506 | 8/1981 | Satterlee | 337/380 |
| 4,297,668 | 10/1981 | Place | 337/380 |
| 4,308,517 | 12/1981 | Peterson | 337/372 |

*Primary Examiner*—Harold Broome

*Attorney, Agent, or Firm*—Pearne, Gordon, Sessions, McCoy, Granger & Tilberry

[57] ABSTRACT

A sealed bimetal snap disc thermostat is disclosed which is suitable for use in environmental locations in which severe thermocycling occurs. The thermostat provides a disc cup having an imperforate end wall which is the only portion of the thermostat per se which is exposed. A non-metallic enclosure cup is formed with an aperture closely encircling the disc cup and which defines a cavity surrounding the remaining portions of the thermostat. A sealing compound, such as epoxy, fills such cavity. The disc cup is crimped onto the thermostat body and provides an extended portion which is spaced from the thermostat body so that the sealing adhesive provides an interface of substantial area with the metal disc cup to assure a continuing seal. Because the sealant and enclosure cup surround the entire thermostat except for the disc cup, the thermostat is thermally insulated from its environment except for the disc cup end face.

11 Claims, 3 Drawing Figures

SEALED THERMOSTAT FOR USE IN DEFROST CONTROL SYSTEMS

BACKGROUND OF THE INVENTION

This invention relates generally to bimetal snap disc thermostats, and more particularly to such a thermostat having improved sensitivity, and which is sealed in a manner permitting reliable use of the thermostat in severe environmental conditions.

PRIOR ART

It is known to provide sealed bimetal snap disc thermostats in which the depth of the metal disc cup is extended to provide a cavity which encloses the entire switch body so that the cavity can be potted or filled with a sealing adhesive such as epoxy to completely seal the thermostat. When such devices are used to sense the temperature of a surface of a tube or plate, the end wall of the disc cup is positioned against the surface being sensed in order to provide good heat transfer from such surface and the snap disc. Also, in some cases in which the surface being sensed is a tube, a clip which fits along the tube surface is welded to the end wall of the disc cup to improve the heat transfer, and thereby improve the sensitivity of the thermostat.

However, when extended disc cups are used to provide a cavity around the switch body to receive the sealing adhesive, a large metal area is exposed that absorbs or dissipates heat to the environment, and such additional cup surface reduces the sensitivity of the thermostat to the surface being sensed.

SUMMARY OF THE INVENTION

The present invention provides a novel and improved sealed thermostat for use in substantially any installation requiring a potted thermostat which is capable of reliably maintaining a good seal. Such thermostat, however, is particularly suited for installations in which the thermostat should provide good response or sensitivity to the temperature of a selected surface.

The illustrated embodiments provide a non-metallic enclosure cup which is structured to expose only the end of the disc cup and to provide a potting cavity completely surrounding the remainder of the thermostat itself. Such cavity is filled with potting compound, such as epoxy, so that all the surfaces of the thermostat, other than the end face of the disc cup, are enclosed within materials having relatively low coefficients of heat transfer. Consequently, the thermostat is highly sensitive to the temperatures of zones in direct heat transfer relationship with the disc cup end face, and the remaining surfaces of the thermostat are thermally insulated to a substantial extent from the environment.

In one embodiment such end face of the disc cup is preferably positioned in direct heat transfer contact with a substantially flat surface. In another embodiment, the disc cup end face is provided with a mounting clip for mounting the thermostat directly on a tube and to provide good heat transfer between the snap disc and the tube.

In accordance with another aspect of this invention, the walls of the disc cup exposed to the potting compound are extended to increase the area of the interface with the potting compound and structured so that the potting compound adheres to both surfaces of at least a portion thereof. Such structure improves the ability of the potting compound to maintain a good seal, even when the thermostat is exposed to severe environmental conditions. For example, the illustrated embodiment maintains a good seal even when the device is subjected to repeated freezing and thawing cycles required for the use of the device in the defrost control system of refrigerators and freezers.

These and other aspects of this invention are illustrated in the accompanying drawings, and are more fully described in the following specification.

DETAILED DESCRIPTION OF THE DRAWINGS

The illustrated embodiments of the present invention are particularly suited for use in the defrost control of refrigerators and freezers. In such an environment, the thermostat must be sufficiently well-sealed to allow it to be repeatedly cycled between freezing conditions and thawing conditions. If the seal is not adequate to maintain the sealing integrity through such severe environment cycling condition, moisture can penetrate into the thermostat mechanism and cause failure of the device.

Further with the present invention, the only metallic portion of the thermostat which is exposed is the end wall of the disc cup. Consequently, the device provides improved sensitivity when such exposed surface is in heat transfer relationship with a surface the temperature of which is to be sensed.

Figure 1:
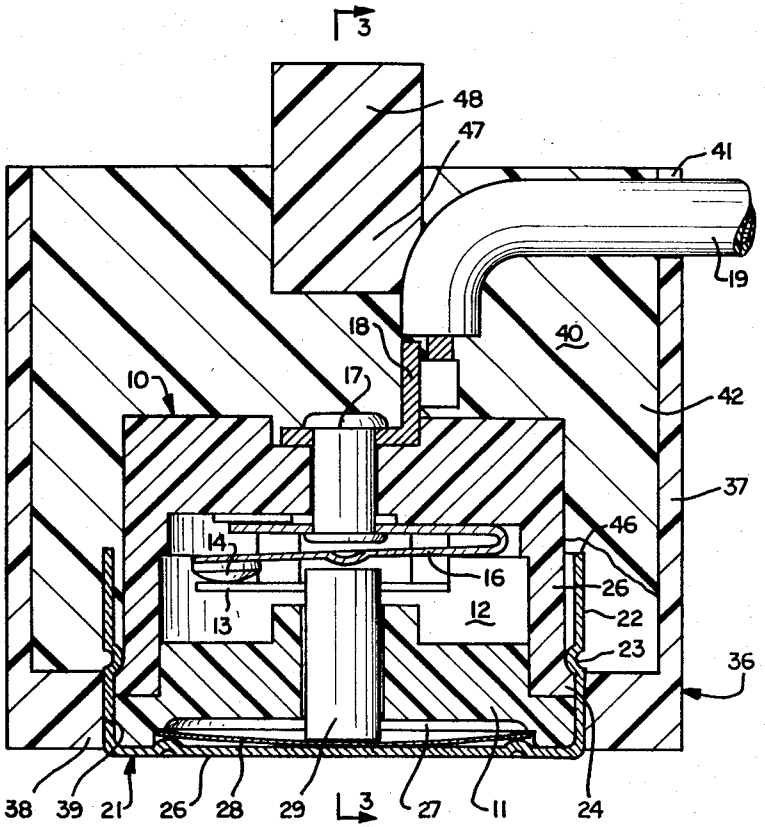
FIG. 1 is a cross section of the first embodiment of this invention, which is particularly suited for sensing the temperature of a relatively flat surface.

Referring to FIG. 1, the thermostat itself provides a cylindrical cup-shaped switch body 10 and a closure member 11. Both the body 10 and closure member 11 are normally formed of a phenolic resin and cooperate to define a switch chamber 12.

Mounted within the switch chamber 12 is a switch which includes a fixed contact 13 and a movable contact 14 supported at the outer end of a resilient movable contact support arm 16. The two contacts 13 and 14 are separately connected through similar rivets 17 and terminals 18 to associated lead wires 19.

A metallic disc cup 21 provides a cylindrical side wall 22 which is crimped at 23 around a shoulder 24 in the body side wall 25 to permanently connect the body 10 to the cover member 11 and the disc cup 21.

The end wall 26 of the disc cup, in cooperation with the cover member 11, defines a disc chamber 27 in which a bimetal snap disc 28 is mounted. Such disc is formed with a shallow dish-shape and snaps back and forth between two positions of stability in response to predetermined temperatures. A bumper 29 extends through an opening in the cover member 11 and connects the disc to the movable contact support arm 16 so the switch operates in response to the snap movement of the disc. In the illustrated position of the disc, it is curved downwardly and the switch is closed. When the disc snaps through to its upper curved position, the bumper 21 is moved upwardly, causing the switch to open.

The structure thus far described is the conventional bimetal snap disc thermostat and is the same structure which has been produced for a number of years, with the exception of the fact that the disc cup side wall 22 extends a substantial distance above the crimp 23. In the past, the disc cup side wall has terminated at the location of the crimp 23.

Positioned around the thermostat is an enclosure cup 36 providing a cylindrical side wall 37 and an end wall 38 formed with a central opening or aperture 39 sized to encircle the disc cup side wall 22 with a close fit. Preferably, the thickness of the end wall 38 is such that it engages the disc cup side wall 22 only along that portion of the side wall between the end wall 26 and the crimp 23.

The enclosure cup 36 is preferably formed of a molded plastic material and is sized so that substantial clearance exists between the outside of the thermostat and the cylindrical side wall 37 of the enclosure cup. Further, the cylindrical side wall of the enclosure cup is preferably sufficiently deep so that the lead wires can be bent along a substantially 90-degree curve and extend out through a notch 41 in the side wall 37.

The enclosure cup defines a cavity 40 which is filled with a sealant material 42 such as epoxy settable adhesive. Such sealant material or potting compound cooperates with the end wall 38 of the enclosure cup 36 to encapsulate or enclose the entire thermostat except for the end wall 26 of the disc cup. Because the epoxy is relatively thermally non-conductive with respect to the metallic material forming the disk cup 21, the thermostat is effectively insulated from its entire environment except for the exposed end wall 26 of the metal disc cup 21. Consequently, the thermostat is highly sensitive to the temperature of such end wall, but is relatively insensitive to the temperature of the remaining environment of the device. Since the snap disc 28 is in direct contact with the disc cup end wall 26, a good metallic path of heat transfer is provided through the disc cup from the surface or zone on the exterior of the end wall.

Figure 3:
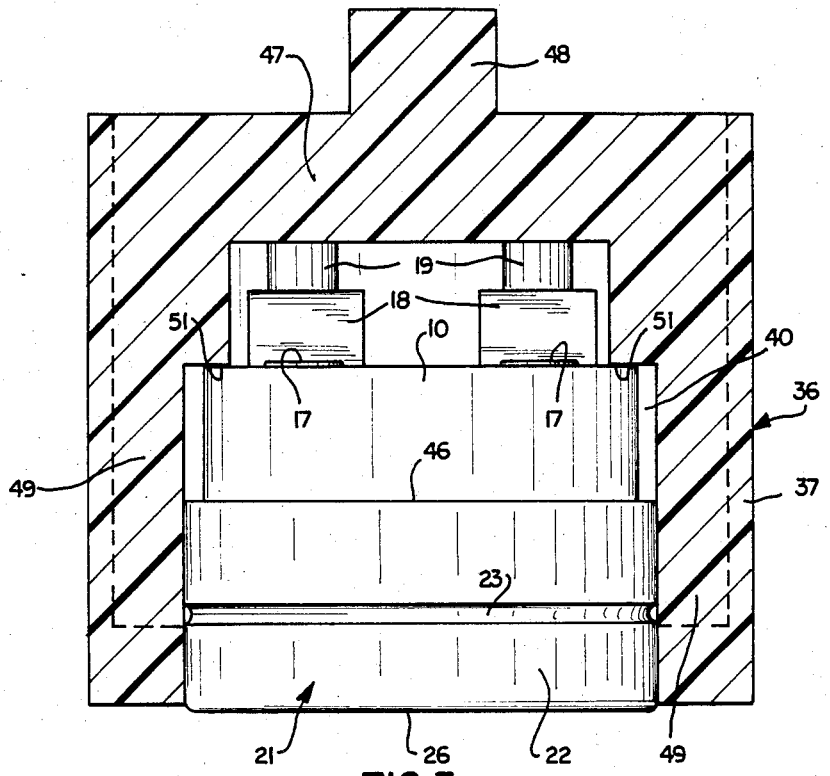
FIG. 3 is a cross section taken along line 3—3 of FIG. 1, with the sealant removed to better illustrate the structure of the enclosure cup and thermostat.

The embodiment of FIGS. 1 and 3 is normally mounted with the end wall 26 engaging a metallic surface within a refrigerator cooling system so that good conductive heat transfer is provided from such surface to the end wall 26 and, in turn, to the disc 28.

In order to achieve a sealing structure which will withstand the thermocycling required in an environment such as the defrost control system of a refrigerator or freezer, the disc cup side wall 22 is extended up from the crimp 23 a substantial distance to an upper end at 46. The portion of the side wall 22 between the lower edge of the crimp 23 and the end 46 is exposed on the exterior to the sealing adhesive 42, and in the illustrated embodiment is also exposed to the sealing adhesive on the inner side between the crimp 23 and the outer end 46. Consequently, a relatively long interface is provided between the metal of the disc cup side wall above the crimp and the sealing adhesive to ensure that a good seal is established that will be maintained even when thermocycling occurs. Consequently foreign material is prevented from entering the switch area.

As best illustrated in FIG. 3, the enclosure cap is also formed with a bridging section 47 extending across the open end of the cup and a generally cylindrical projection 48 extending from the upper side thereof. Such bridging section and projection provides a mounting structure for connecting a mounting clip (not illustrated) for securing the thermostat in its installed position.

As illustrated in FIG. 3, the side walls 37 are provided with diametrically opposed, inwardly extending projections 49 along the side walls 37, which operate to center the thermostat within the opening. Further, such side wall projections 49 are formed with a shoulder 51 against which the upper ends of the body are seated to axially locate the thermostat within the enclosure cup prior to the potting with the sealing adhesive.

Figure 2:
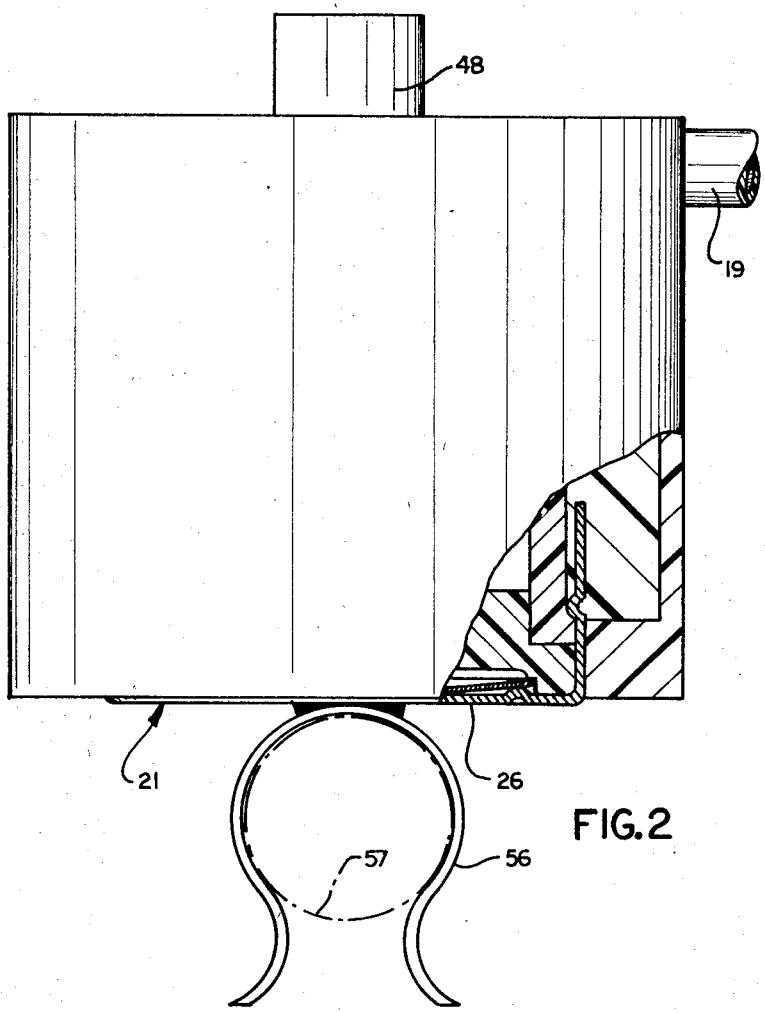
FIG. 2 is a partial cross section of a second embodiment provided with a clip adapted to snap onto a tube for mounting the thermostat and for improving the thermal sensitivity of the thermostat with respect to the tube surface.

FIG. 2 illustrates a second embodiment which is structurally identical to the first embodiment except that an arcuate spring clip 56 is welded to the end wall 26 of the disc cup 21 and is shaped to tightly embrace a tube illustrated in phantom at 57. Such spring clip provides a direct heat conducting path from the tube 57 through the clip 56 to the end wall 26 and, in turn, to the snap disc 58. Such structure in combination with the insulating properties of the potting compound and the enclosure cup creates a combination which provides a high degree of sensitivity to the temperature of the tube 57.

With this invention, a structure is provided in which a high quality, reliable seal is provided by the same potting compound which thermally insulates the thermostat from all of its environment except for the exposed end wall portion of the disc cup.

Although the preferred embodiments of this invention have been shown and described, it should be understood that various modifications and rearrangements of the parts may be resorted to without departing from the scope of the invention as disclosed and claimed herein.

What is claimed is:

1. A sealed thermostat comprising a body assembly including a metallic cup having an imperforate end wall in thermal communication with a temperature-responsive member, enclosure means enclosing said body assembly while leaving said end wall exposed and cooperating with said body assembly to define a sealing cavity, and a sealing compound filling said sealing cavity, said cup providing side walls extending a substantial distance into said sealing cavity and providing an interface of substantial area with said sealing compound to prevent foreign material from entering said body assembly, said enclosure means being generally cup-shaped and providing an apertured wall through which said metallic cup extends to expose said end wall.

2. A sealed thermostat as set forth in claim 1, wherein said metallic cup provides a generally cylindrical side wall extending to an open end and providing a substantial portion having an interface with said sealing compound along both the inner and outer surfaces thereof, said sealing compound preventing said entry of foreign material even when said thermostat is exposed to repeated freezing and thawing cycles.

3. A sealed thermostat as set forth in claim 2, wherein said sealing compound is a settable adhesive which is cast in place within said cavity.

4. A sealed thermostat as set forth in claim 3, wherein said temperature-responsive member is a bimetal snap disc, and said body assembly provides a switch operated by said snap disc.

5. A sealed thermostat as set forth in claim 4, wherein said settable adhesive has a thermal conductivity of the metal of said metallic cup and operates to cause said thermostat to be relatively insensitive to the temperatures of it environment except through said end wall of said metallic cup.

6. A sealed thermostat as set forth in claim 5 wherein said body assembly includes a cylindrical body member projecting into said metallic cup, said side wall of said metallic cup being crimped onto said body member to interconnect the two together.

7. A sealed thermostat as set forth in claim 6, wherein said crimp in said side wall of said metallic cup is spaced from said open end of said side wall, and both the interior and exterior portions of said side wall between said crimp and open end are in adhesive contact with said sealing compound.

8. A sealed thermostat as set forth in claim 1, wherein a metallic clip is mounted on said end wall and is proportioned to encircle at least a portion of a tube, said clip operating to provide a metallic conductive path from a tube to said end wall.

9. A sealed thermostat comprising a thermally responsive assembly including a switch body with a switch mounted therein, a bimetal snap disc connected to operate said switch, and a metallic disc cup providing an imperforate end wall in thermal communication with said bimetal snap disc, a non-metallic cup-shaped enclosure member providing side walls spaced from said thermally responsive assembly and an apertured end wall extending inwardly into contact with said disc cup to define a sealing cavity around said thermally responsive assembly while leaving said end wall of said disc cup exposed, and a potting compound filling said sealing cavity, said disc cup providing a substantial surface portion in adhesive contact with said potting compound, said potting compound and disc cup cooperating to seal said thermostat against the entry of foreign material into said thermostat even when said thermostat is exposed to repeated severe thermal cycles.

10. A sealed thermostat as set forth in claim 9, wherein said potting compound and enclosure member have a thermal conductivity substantially lower than the thermal conductivity of said disc cup, whereby said thermostat is relatively insensitive to environmental temperatures except through said end wall of said disc cup.

11. A sealed bimetal snap disc thermostat comprising generally cylindrical body means defining a switch chamber, a switch in said chamber, a generally cylindrical metallic disc cup mounted on said body means and cooperating therewith to define a disc seat, a bimetal snap disc in said disc seat connected to operate said switch with snap action in response to predetermined operating temperatures, said cup providing a cylindrical wall which is crimped intermediate its ends against the exterior of said body means to connect said body means and cup and providing a substantial portion of said cylindrical wall extending along and spaced from said exterior wall to define an annular space therebetween, a non-metallic enclosure cup having an end wall formed with an opening therein closely fitting the periphery of said disc cup and substantially flush with the end wall of said disc cup, said enclosure cup providing a side wall extending around said body means with clearance, and a sealing adhesive filling said enclosure cup around said body means and extending into said annular space to provide an interface with said disc cup and adhesive of substantial area to seal said thermostat.

* * * * *

UNITED STATES PATENT AND TRADEMARK OFFICE

CERTIFICATE OF CORRECTION

PATENT NO. : 4,626,821

DATED : December 2, 1986

INVENTOR(S) : Douglas P. Versaw

It is certified that error appears in the above-identified patent and that said Letters Patent is hereby corrected as shown below:

On the face of the patent Section [73] Assignee should read as follows:
--[73] Assignee: Therm-O-Disc, Incorporated, Mansfield, Ohio--.

Column 4, Line 66, after "conductivity" should be inserted --substantially lower than the thermal conductivity--.

Signed and Sealed this

Twenty-fourth Day of February, 1987

*Attest:*

DONALD J. QUIGG

*Attesting Officer* *Commissioner of Patents and Trademarks*